US007604212B2

(12) United States Patent
Tsai

(10) Patent No.: US 7,604,212 B2
(45) Date of Patent: Oct. 20, 2009

(54) COLLAPSIBLE FRAME HAVING A BASE MECHANISM

(76) Inventor: Ming-Liang Tsai, 4F-3, No. 8, Fu Ching St., Taipei (TW)

( * ) Notice: Subject to any disclaimer, the term of this patent is extended or adjusted under 35 U.S.C. 154(b) by 457 days.

(21) Appl. No.: 11/689,095

(22) Filed: Mar. 21, 2007

(65) Prior Publication Data

US 2008/0229681 A1 Sep. 25, 2008

(51) Int. Cl.
*A47B 91/00* (2006.01)

(52) U.S. Cl. ..... 248/346.3; 52/109; 135/121; 135/145; 135/148; 119/474

(58) Field of Classification Search ..... 52/109; 248/277.1, 346.3; 119/474, 499; 135/121, 135/145, 147, 148, 159, 116
See application file for complete search history.

(56) References Cited

U.S. PATENT DOCUMENTS 4,739,527 A * 4/1988 Kohus et al. ..... 5/99.1
6,206,020 B1 * 3/2001 Lynch ..... 135/128
6,929,017 B2 * 8/2005 Byun ..... 135/145
7,377,231 B2 * 5/2008 Tsai ..... 119/499

* cited by examiner

*Primary Examiner*—J. Allen Shriver, II
*Assistant Examiner*—Bradley H Duckworth
(74) *Attorney, Agent, or Firm*—WPAT, P.C.; Anthony King

(57) ABSTRACT

A collapsible frame has a base mechanism. The base mechanism comprises a first connector and a second connector which are pivotally connected to the bottom of the collapsible frame. The first connector is pivotally connected with first reinforcement legs. The bottom of the first connector is formed with a first trough. The second connector and the first connector are overlapped and engaged with each other. The second connector is pivotally connected with a second reinforcement legs. The top of the second connector is formed with a second trough. The first and second reinforcement legs are pivotally connected to the bottom of the collapsible frame.

8 Claims, 6 Drawing Sheets

COLLAPSIBLE FRAME HAVING A BASE MECHANISM

BACKGROUND OF THE INVENTION

1. Field of the Invention

The present invention relates to a collapsible frame, in particular a collapsible frame for multiple purposes that comprises two overlapped connectors to support the collapsible frame when it is expanded and to minimize the size when it is collapsed.

2. Description of the Prior Art

In the modern days, the technology tends to develop new devices which are compact in size and have powerful functions. As disclosed in Taiwanese Patent No. M243088, a reinforcing structure of a foldable frame which comprises multiple retractable side posts equally spaced from each other. In between every two posts there is a scissors-like linking rod set. Each side post has a connecting device to be connected with the scissors-like linking rod. The bottom of each side post is connected with a reinforcing rod which has another end pivotally connected to the center of a connector.

The structure is not strong enough due to a single connector to support the weight, and may cause the side post as well as the reinforcing rod to deform after a period of time.

SUMMARY OF THE INVENTION

The present invention provides a base mechanism for a collapsible frame, which has a reinforcing design when the collapsible frame is in an open status.

According to the present invention, there is provided with a collapsible frame having a base mechanism, the base mechanism comprising a first connector and a second connector, said first connector and said second connector being pivotally connected to the bottom of the collapsible frame; said first connector being pivotally connected with first reinforcement legs, the bottom of said first connector being formed with a first trough; said second connector and said first connector being overlapped and engaged with each other, said second connector being pivotally connected with second reinforcement legs, the top of said second connector being formed with a second trough, said first and second reinforcement legs being pivotally connected to the bottom of the collapsible frame, wherein said first trough and said second trough are formed in a cross shape, and said first trough is at a 45 degree angle to said second trough, wherein the collapsible frame comprises four first side posts, four second side posts, four pairs of scissors-like linking rod sets, first reinforcement legs, and second reinforcement legs; each said first side post having an upper end and a lower end, said upper end being fixedly connected with a first connecting holder and said lower end being provided with a second connecting holder; each said second side post being located between two abutted first side posts, each said second side post having an upper end and a lower end, said upper end being fixedly connected with a third connecting holder and said lower end being provided with a fourth connecting holder; each said scissors-like linking rod set being formed by a pair of rods located between abutted said first side post and said second side post; each said first reinforcement leg having a first end and a second end, said first end being pivotally connected to said second connecting holder and said second end being pivotally connected to said first connector; each said second reinforcement leg having a first end and a second end, said first end being pivotally connected to said fourth connecting holder and said second end being pivotally connected to said second connector, wherein each said scissors-like linking rod set comprises a first end, a second end, a third end and a fourth end at respective sides thereof, wherein said first connecting holder comprises a first end and a second end which are pivotally connected with said first ends of said two neighboring scissors-like linking rod sets, respectively, wherein said third connecting holder comprises a first end and a second end which are pivotally connected with said third ends of said two neighboring scissors-like linking rod set, respectively, wherein said second connecting holder comprises a first end, a second end and a third end, wherein said first end and said second end are pivotally connected with said second ends of said two neighboring scissors-like linking rod sets, and said third end of said second connecting holder is pivotally connected with said first end of said first reinforcement leg, wherein said fourth connecting holder comprises a first end, a second end and a third end, wherein said first end and said second end are pivotally connected with said fourth ends of said two neighboring scissors-like linking rod sets, and said third end of said fourth connecting holder is pivotally connected with said first end of said second reinforcement leg.

It is the primary object of the present invention to provide a collapsible frame having a base mechanism, which has the first connector and the second connector overlapped and engaged with each other to provide a strong support to the collapsible frame in an open status.

It is another object of the present invention to provide a collapsible frame having a base mechanism, which can be collapsed into a compact size for storage.

DETAILED DESCRIPTION OF THE PREFERRED EMBODIMENT

Figure 1:
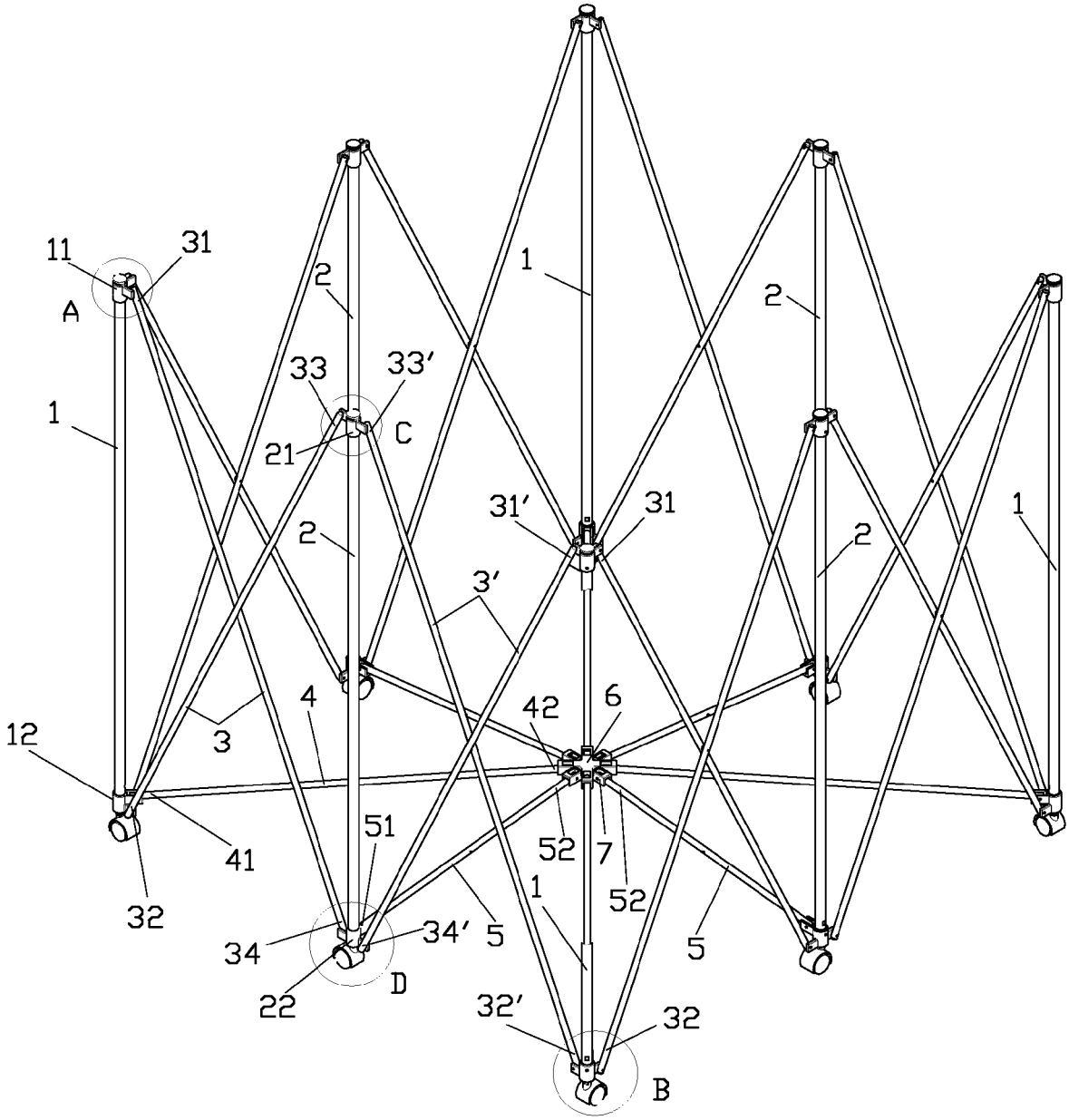
FIG. 1 is a perspective view of a preferred embodiment of the present invention in an open status.
Figure 1A:
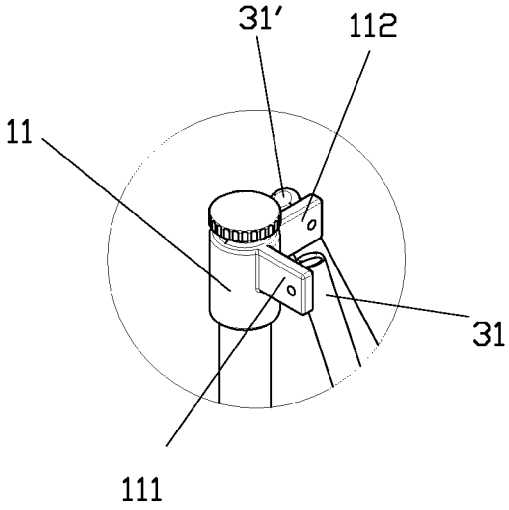
FIGS. 1A, 1B, 1C, 1D are enlarged views taken from circles A, B, C and D of FIG. 1 showing first, second, third and fourth connecting holders of the preferred embodiment of the present invention.
Figure 1C:
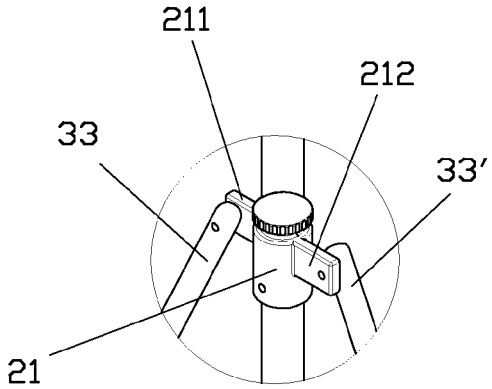
Figure 1D:
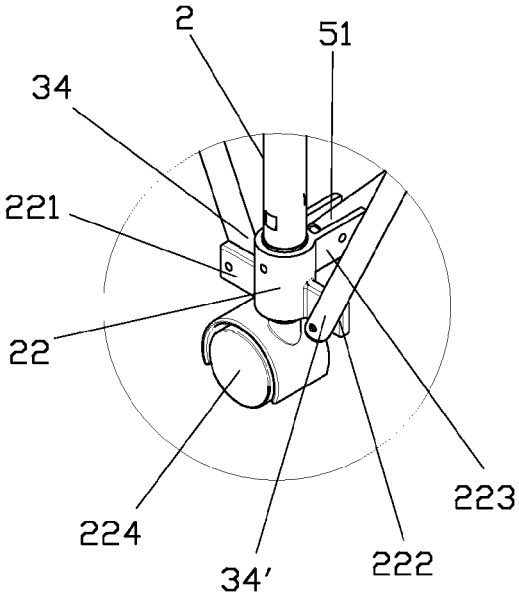
Figure 1B:
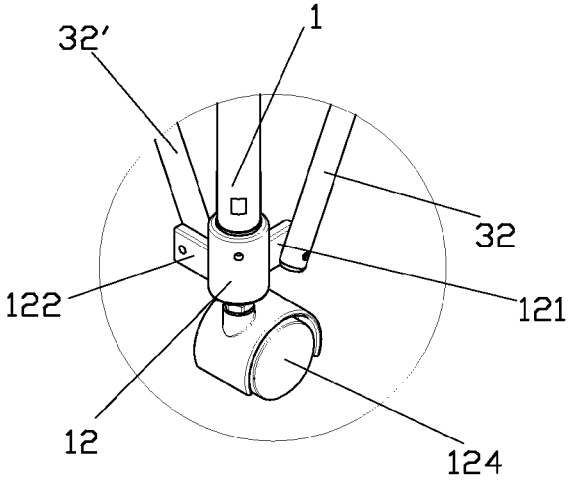
Figure 2:
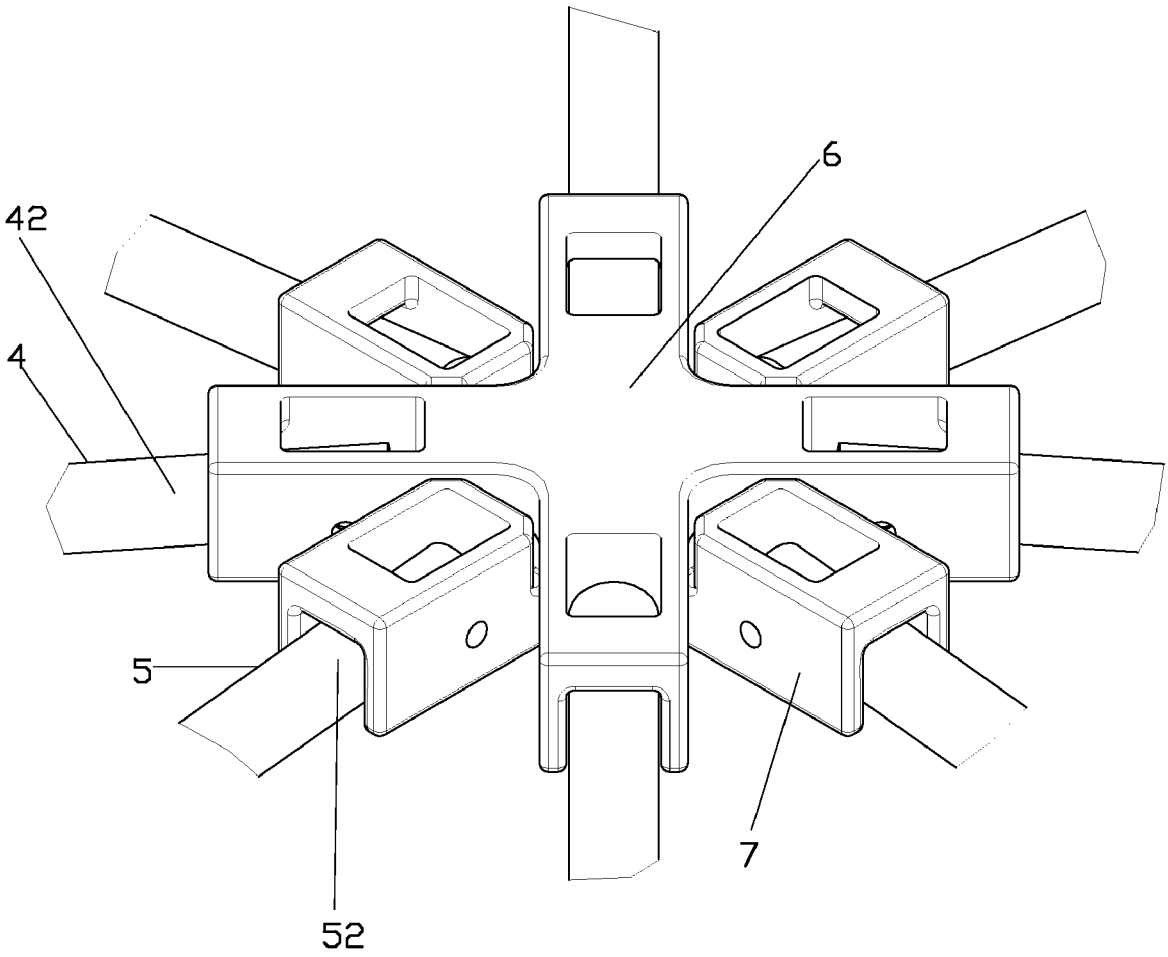
FIG. 2 is an enlarged view of first and second connectors of the preferred embodiment of the present invention.
Figure 3:
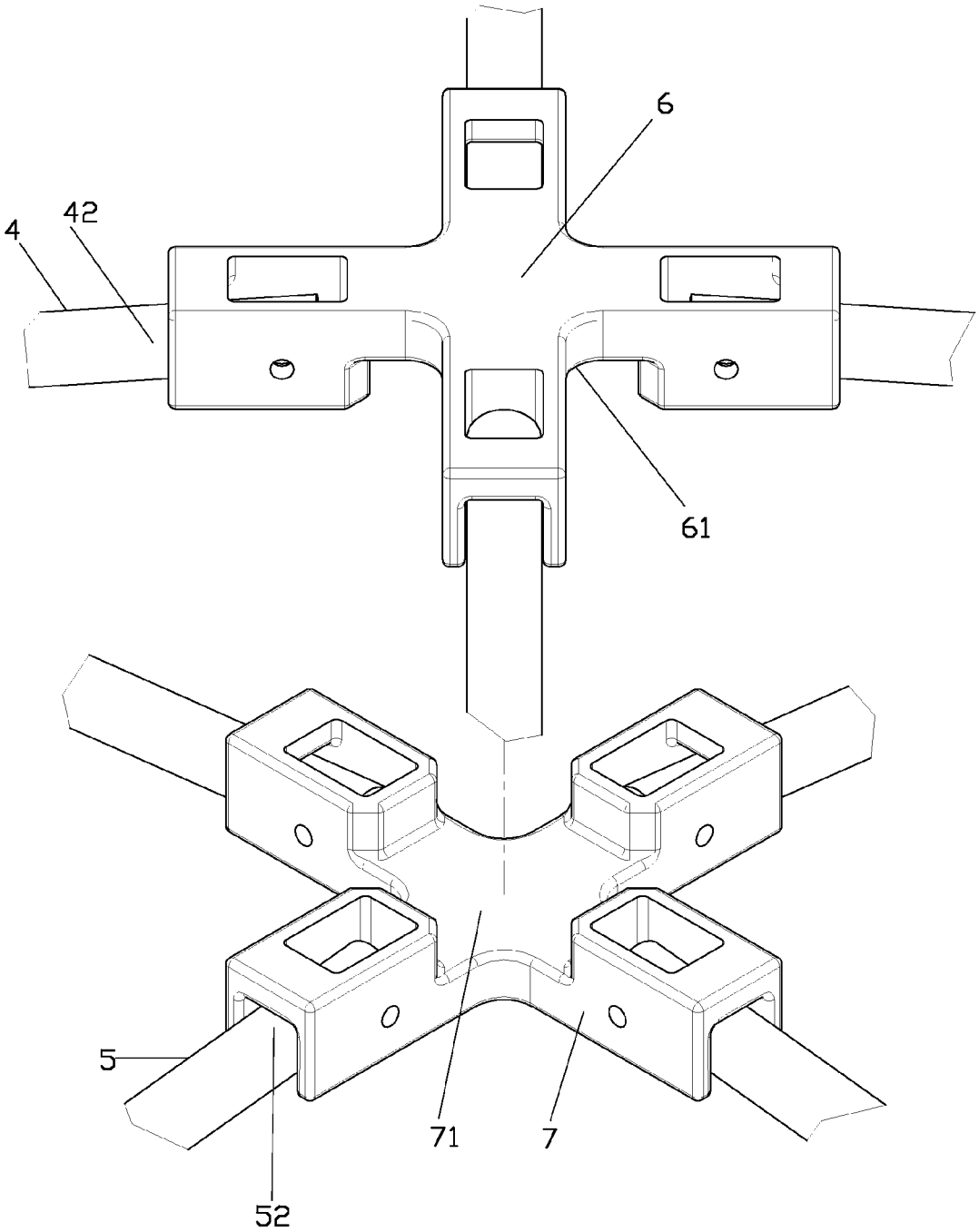
FIG. 3 is an exploded view of the first and second connectors of the preferred embodiment of the present invention.

As shown in FIGS. 1, 2 and 3, the present invention comprises a collapsible frame and a base mechanism. The base mechanism comprises a first connector 6 and a second connector 7 which are pivotally connected to the bottom of the collapsible frame. The collapsible frame comprises four first side posts 1, four second side posts 2, four pairs of scissors-like linking rod sets 3 and 3', four first reinforcement legs 4, four second reinforcement legs 5.

The four first side posts 1 are located at four corners of the collapsible frame. The upper end of each first side post 1 is fixedly connected with a first connecting holder 11. The first connecting holder 11 has a first end 111 and a second end 112. The lower end of each first side post 1 is provided with a movable second connecting holder 12. The second connecting holder 12 has a first end 121, a second end 122, and a third end 123. The bottom of the second connecting holder 12 is equipped with a caster 124 for easy movement.

Each second side post 2 is located between two abutted first side posts 1. The upper end of each second side post 2 is fixedly connected with a third connecting holder 21. The third connecting holder 21 has a first end 211 and a second end 212. The lower end of each second side post 2 is provided with a movable fourth connecting holder 22. The fourth connecting holder 22 has a first end 221, a second end 222, and a third end 223. The bottom of the fourth connecting holder 22 is equipped with a caster 224 for easy movement.

Each pair of the scissors-like linking rod sets 3 and 3' are arranged in an opposite direction. Each of the scissors-like linking rod sets 3 and 3' is formed by a pair of rods located between an abutted first side post 1 and an abutted second side post 2. Each scissors-like linking rod set 3 has a first end 31, a second end 32, a third end 33, and a fourth end 34 at respective sides thereof. Each scissors-like linking rod set 3' has a first end 31', a second end 32', a third end 33', and a fourth end 34' at respective sides thereof. The first ends 31 and 31' are pivotally connected to the first end 111 and the second end 112 of the first connecting holder 11. The second ends 32 and 32' are pivotally connected to the first end 121 and the second end 122 of the second connecting holder 12. The third ends 33 and 33' are pivotally connected to the first end 211 and the second end 212 of the third connecting holder 21. The fourth ends 34 and 34' are pivotally connected to the first end 221 and the second end 222 of the fourth connecting holder 22.

Each first reinforcement leg 4 has a first end 41 and a second end 42. The first end 41 is pivotally connected to the third end 123 of the second connecting holder 12.

Each second reinforcement leg 5 has a first end 51 and a second end 52. The first end 51 is pivotally connected to the third end 223 of the fourth connecting holder 22.

The first connector 6 of the base mechanism is for the second end 42 of each first reinforcement leg 4 to be secured thereat. The bottom of the first connector 6 is formed with a first cross-shaped trough 61.

The second connector 7 of the base mechanism is for the second end 52 of each second reinforcement leg 5 to be secured thereat. The top of the second connector 7 is formed with a second cross-shaped trough 71. The second cross-shaped trough 71 of the second connector 7 is at a 45 degree angle to the first cross-shaped trough 61 of the first connector 6.

To expand the collapsible frame of the present invention, the four first side posts 4 and the four second side posts 2 will be linked by the scissors-like linking rod sets 3 and 3' to move outwardly until the first reinforcement legs 4 and the second reinforcement legs 5 are expanded entirely. The first trough 61 of the first connector 6 and the second trough 71 of the second connector 7 are overlapped and secured, providing a strong support of the first side posts 1 and the first reinforcement legs 4 as well as the second side posts 2 and the second reinforcement legs 5. In this case, even the collapsible frame is under a heavy weight, other than the first side posts 1 and the second side posts 2 support the weight, the first reinforcement legs 4 and the second reinforcement legs 5 at the bottom will function as an auxiliary support. The overlapping connection of the first connector 6 and the second connector 7 will also support the weight to maintain stability.

Furthermore, both the second connecting holder 12 and the fourth connecting holder 22 comprise the casters 124 and 224 to provide mobility.

Figure 4:
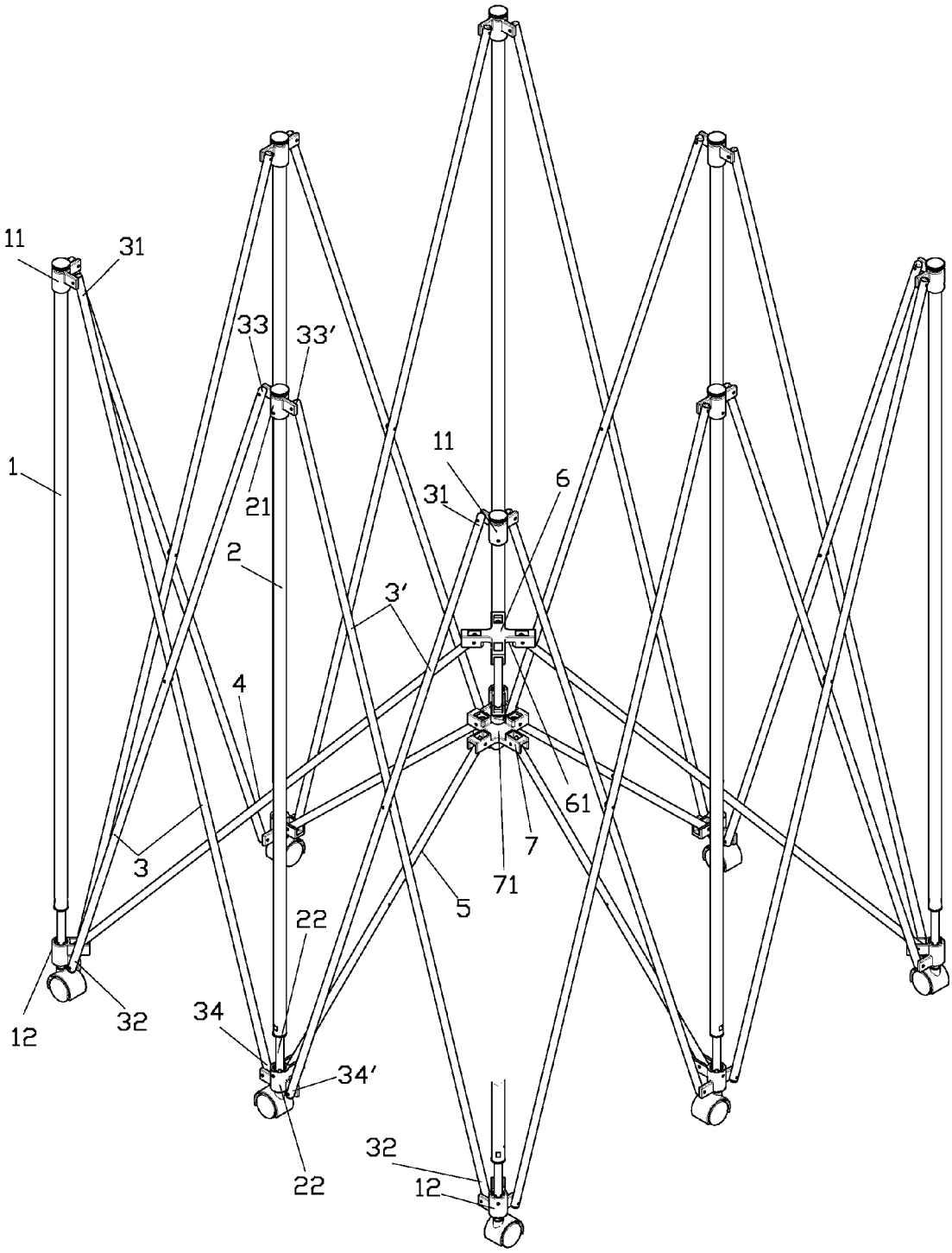
FIG. 4 is a perspective view of the preferred embodiment of the present invention in a half collapsed status.
Figure 5:
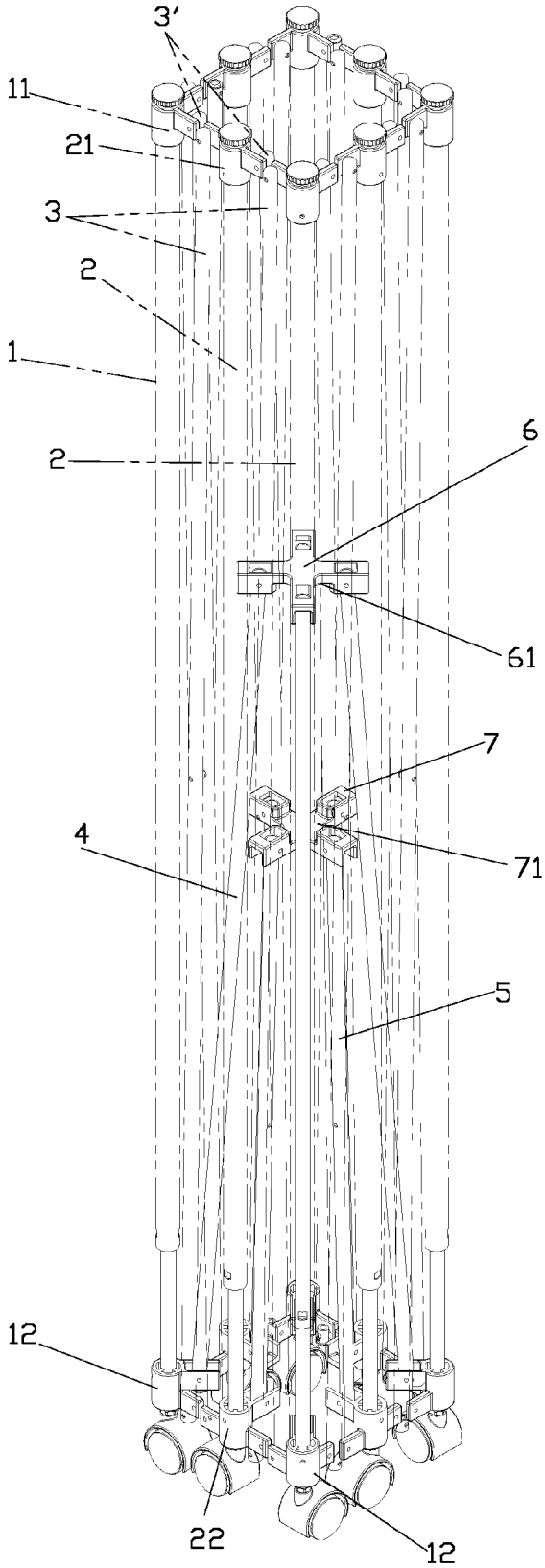
FIG. 5 is a perspective of the preferred embodiment of the present invention in a fully collapsed status.

To fold the present invention, as shown in FIG. 4, the first connector 6 is lifted up, which will link the first reinforcement legs 4 to move inwardly, and then the first connector 6 will away from the second connector 7 so that the first side posts 1, the second side posts 2, the scissors-like linking rod sets 3 and 3' are linked to move inwardly. The second ends 42 of the first reinforcement legs 4 to be linked move upward to support the first connector 6. The overlapping connection of the first trough 61 of the first connector 6 and the second trough 71 of the second connector 7 is separated as the first connector 6 continuously moves upward. As shown in FIG. 5, the first side posts 1 and the second side posts 2 are folded, and the scissors-like linking rod sets 3 and 3' are collapsed to the smallest size. The first reinforcement legs 4 and the second reinforcement legs 5 are in a vertical status close to the first side posts 1 and the second side posts 2 to be in an entire collapsed status. The first connecting holders 11 and the second connecting holders 12 of the first side posts 1 and the third connecting holders 21 and the fourth connecting holders 22 of the second side posts 2 are to form a small box for storage.

What is claimed is:

1. A collapsible frame having a base mechanism, the base mechanism comprising a first connector and a second connector, said first connector and said second connector being pivotally connected to the bottom of the collapsible frame; said first connector being pivotally connected with first reinforcement legs, the bottom of said first connector being formed with a first trough; said second connector and said first connector being overlapped and engaged with each other, said second connector being pivotally connected with second reinforcement legs, the top of said second connector being formed with a second trough, said first and second reinforcement legs being pivotally connected to the bottom of the collapsible frame.

2. The collapsible frame having a base mechanism, as recited in claim 1, wherein said first trough and said second trough are formed in a cross shape, and said first trough is at a 45 degree angle to said second trough.

3. The collapsible frame having a base mechanism, as recited in claim 1, wherein the collapsible frame comprises four first side posts, four second side posts, four pairs of scissors-like linking rod sets, first reinforcement legs, and second reinforcement legs; each said first side post having an upper end and a lower end, said upper end being fixedly connected with a first connecting holder and said lower end being provided with a second connecting holder; each said second side post being located between two abutted first side posts, each said second side post having an upper end and a lower end, said upper end being fixedly connected with a third connecting holder and said lower end being provided with a fourth connecting holder; each said scissors-like linking rod set being formed by a pair of rods located between abutted said first side post and said second side post; each said first reinforcement leg having a first end and a second end, said first end being pivotally connected to said second connecting holder and said second end being pivotally connected to said first connector; each said second reinforcement leg having a first end and a second end, said first end being pivotally connected to said fourth connecting holder and said second end being pivotally connected to said second connector.

4. The collapsible frame having a base mechanism, as recited in claim 3, wherein each said scissors-like linking rod set comprises a first end, a second end, a third end and a fourth end at respective sides thereof.

5. The collapsible frame having a base mechanism, as recited in claim 4, wherein said first connecting holder comprises a first end and a second end which are pivotally connected with said first ends of said two neighboring scissors-like linking rod sets, respectively.

6. The collapsible frame having a base mechanism, as recited in claim 4, wherein said third connecting holder comprises a first end and a second end which are pivotally connected with said third ends of said two neighboring scissors-like linking rod set, respectively.

7. The collapsible frame having a base mechanism, as recited in claim 4, wherein said second connecting holder comprises a first end, a second end and a third end, wherein said first end and said second end are pivotally connected with said second ends of said two neighboring scissors-like linking rod sets, and said third end of said second connecting holder is pivotally connected with said first end of said first reinforcement leg.

8. The collapsible frame having a base mechanism, as recited in claim 4, wherein said fourth connecting holder comprises a first end, a second end and a third end, wherein said first end and said second end are pivotally connected with said fourth ends of said two neighboring scissors-like linking rod sets, and said third end of said fourth connecting holder is pivotally connected with said first end of said second reinforcement leg.

* * * * *